United States Patent [19]

Cook

[11] Patent Number: 4,705,609

[45] Date of Patent: Nov. 10, 1987

[54] METHOD FOR DERIVING PHENYL ISOCYANATE FROM BENZENE AND POTASSIUM ISOCYANATE

[76] Inventor: Ronald L. Cook, 4260 Westbrook Dr. No. 111, Aurora, Ill. 60505

[21] Appl. No.: 929,868

[22] Filed: Nov. 13, 1986

[51] Int. Cl.[4] ..... C25C 3/00

[52] U.S. Cl. ..... 204/59 R; 204/182.3; 560/330

[58] Field of Search ..... 204/59 R, 182.3; 560/330

[56] References Cited

U.S. PATENT DOCUMENTS 4,430,262 2/1984 Engels et al. ..... 204/59 R 4,563,254 1/1986 Morduchowitz ..... 204/59 R

*Primary Examiner*—Arthur P. Demers

*Attorney, Agent, or Firm*—Robert A. Kulason; James J. O'Loughlin; Ronald G. Gillespie

[57] ABSTRACT

A method deriving phenyl isocyanate includes providing an electrolyte. The electrolyte is separated by an ion transferrable member so as to form a catholyte and an anolyte from the electrolyte. A cathode is placed in the catholyte and an anode is placed in the anolyte. Benzene and potassium isocyanate are provided to the anolyte. An electric voltage is applied across the cathode and the anode causing a reaction of the benzene and potassium isocyanate to yield phenyl isocyanate.

6 Claims, 1 Drawing Figure

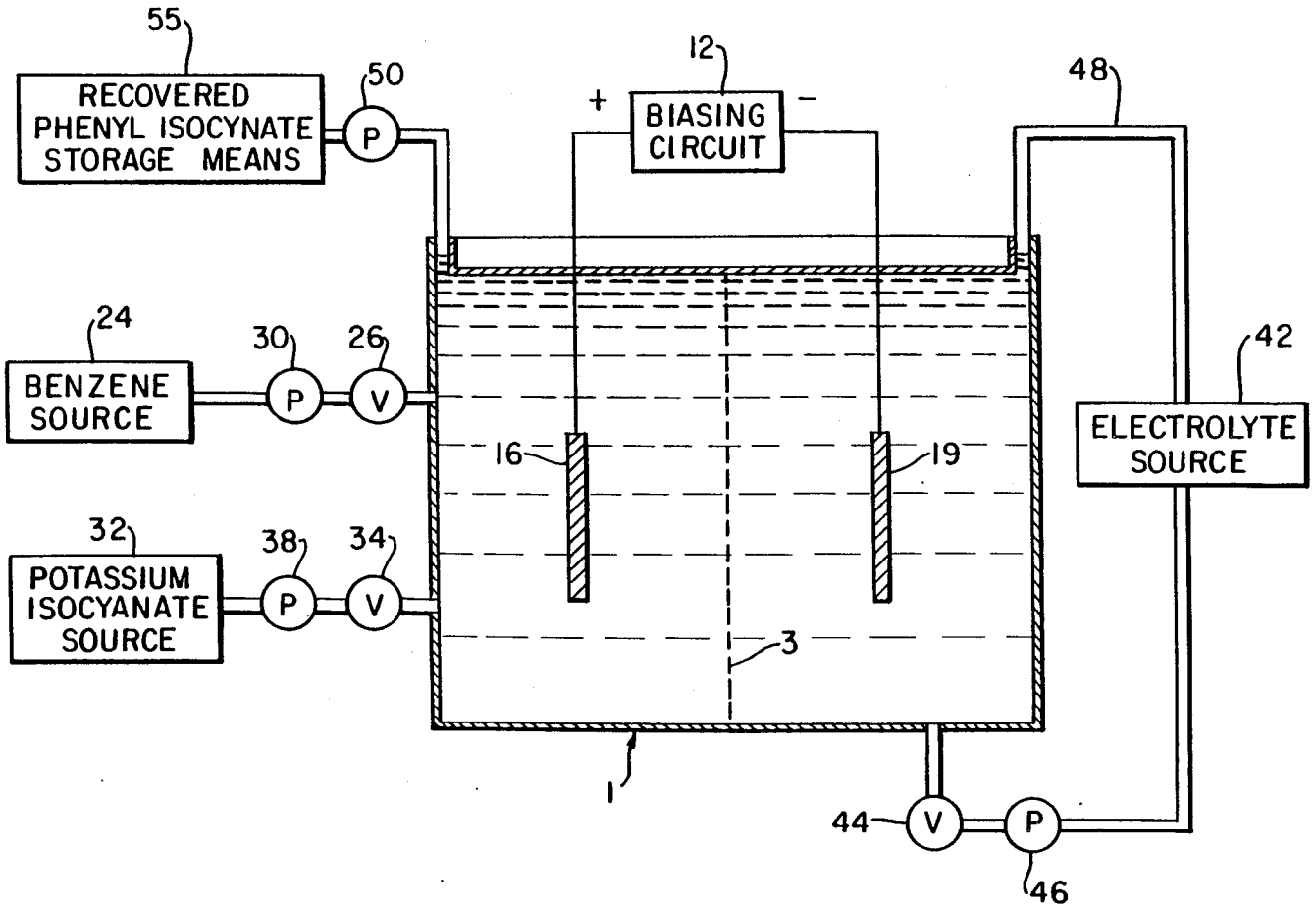
ELECTROLYTE SOURCE
42
48
46
44
19
3
1
BIASING CIRCUIT
12
+
−
16
50
26
34
30
38
RECOVERED PHENYL ISOCYNATE STORAGE MEANS
55
BENZENE SOURCE
24
POTASSIUM ISOCYANATE SOURCE
32

METHOD FOR DERIVING PHENYL ISOCYANATE FROM BENZENE AND POTASSIUM ISOCYANATE

BACKGROUND OF THE INVENTION

FIELD OF THE INVENTION

The present invention relates to electrochemical processes for deriving a chemical product from other chemicals.

SUMMARY OF THE INVENTION

A method deriving phenyl isocyanate includes providing an electrolyte. The electrolyte is separated by an ion transferrable member so as to form a catholyte and an anolyte from the electrolyte. A cathode is placed in the catholyte and an anode is placed in the anolyte. Benzene, potassium isocyanate, and a phase transfer agent are provided to the anolyte. An electric voltage is applied across the cathode and the anode causing a reaction of the benzene with the solubilized potassium isocyanate to yield phenyl isocyanate.

The objects and advantages of the invention will be described more fully hereinafter from a consideration of the detailed description which follows, taken together with the accompanying drawing wherein one embodiment of the invention is illustrated by way of example. It is to be expressly understood, however, that the drawing is for illustration purposes only and is not to be construed as defining the limits of the invention.

DESCRIPTION OF THE DRAWING

The drawing is in partial block diagram form and partial mechanical drawing form shows apparatus, constructed in accordance with the present invention, for the forming of phenyl isocyanate from benzene and potassium isocyanate.

DESCRIPTION OF THE INVENTION

Anodic substitution reactions are common in organic electrochemistry. The overall reaction being represented by $$R{-}E + Nu^- \rightarrow R{-}Nu + e^- + E^+$$

where E=electrophile and $Nu^-$=nucleophile

In the present invention, benzene is oxidized in acetonitrile to form a radical cation. The isocyanate anion (solubilized by the 18-crown-6 polyether) then attacks the activated ring to give a phenyl isocyanate radical which then loses a proton to give phenyl isocyanate. The 18-crown-6 acts as a solid to liquid phase transfer catalyst bringing the insoluble KOCN into the acetonitrile solution. A schematic is shown below.

$$C_6H_6 \rightarrow C_6H_6^+ + e^-$$

$$[\text{18-crown-6 } K^+]NCO^- + C_6H_6^+ \rightarrow C_6H_6NCO + [\text{18-crown-6 } K^+]$$

$$C_6H_6NCO \rightarrow C_6H_5NCO + e^- + H^+$$

$$OCN^- + [\text{18-crown-6 } K^+] \rightarrow [\text{18-crown-6 } K^+]OCN^-$$

Referring to the Figure, there is shown a housing 1 made of suitable material to contain an electrolyte solution having a membrane 3. The membrane 3 will pass ions. Contained within housing 1 is an electrolyte solution including a non-aqueous electrolyte, such as dimethylformamide, and a supporting electrolyte selected from the following: tetrabutylammonium perchlorate, lithium perchlorate, magnesium perchlorate and ammonium perchlorate.

A biasing circuit 12 has a positive terminal connected to an anode 16 and a negative terminal connected to a cathode 19. Anode 16 may be made of platinum and cathode 19 may be made of platinum or copper. A source 24 provides benzene through a valve 26, using a pump 30, to the anode section or housing 1. A source 32 provides solubilized $OCN^-$ through the use of (18-crown-6 $K^+$)$OCN^-$ to anode section of housing 1, through a valve 34, using a pump 38. A source 42 provides the electrolyte solution to housing 1 through a valve 44 aided by a pump 46. The electrolyte solution leaving housing 1 is returned to electrolyte source 42 by way of a line 48. The pump 50 removes phenyl isocyanate from the anode section of housing 1 and provides to recovered phenyl isocyanate storage means 55.

In summary, the present invention can be thought of as a method of deriving phenyl isocyanate which comprises the steps of providing an electrolyte, separating the electrolyte solution with an ion transferrable membrane so as to form a catholyte solution and an anolyte solution from the electrolyte, placing a cathode in the catholyte and an anode in the anolyte, providing benzene to the anolyte, providing solubilized $OCN^-$, through the use of (18-crown-6$K^+$)$OCN^-$, to the anolyte and providing an electrical voltage across the cathode and the anode so as to cause the reaction of the benzene, $OCN^-$ to yield phenyl isocyanate. Further, the electrolyte solution would include a non-aqueous electrolyte and a supporting electrolyte. The non-aqueous electrolyte may be nitromethane. The supporting electrolyte may be selected from a group of electrolytes consisting of: tetrabutylammonium perchlorate, lithium perchlorate, magnesium perchlorate and ammonium perchlorate. Further yet, the process may include placing a cathode made of platinum in the catholyte and an anode made of platium in the anolyte, or it could include placing a cathode made of copper in the catholyte and an anode made of platimun in the anolyte.

What is claimed is:

1. A method of deriving phenyl isocyanate comprising the steps of:

providing an electrolyte, separating the electrolyte solution with an ion transferrable membrane so as to form a catholyte solution and an anolyte solution from the electrolyte, placing a cathode in the catholyte and an anode in the anolyte, providing benzene to the anolyte, providing solubilized $OCN^-$, through the use of (18-crown-6$K^+$)$OCN^-$, to the anolyte, and providing an electrical voltage across the cathode and the anode so as to cause a reaction of the benzene, $OCN^-$ to yield phenyl isocyanate.

2. A method as described in claim 1 in which the electrolyte solution includes:

a non-aqueous electrolyte and a supporting electrolyte.

3. a method as described in claim 2 in which the non-aqueous electrolyte is nitromethane.

4. A method as described in claim 3 in which the supporting electrolyte is selected from a group of electrolytes consisting of: tetrabutylammonium perchlorate, lithium perchlorate, magnesium perchlorate and ammonium perchlorate.

5. A method as described in claim 4 in which the placing step includes:

placing a cathode made of platinum in the catholyte and an anode made of platinum in the anolyte.

6. A method as described in claim 4 in which the placing step includes:

placing a cathode made of copper in the catholyte and an anode made of platinum in the anolyte.

* * * * *